United States Patent [19]

Pettitt

[11] Patent Number: 4,491,409

[45] Date of Patent: Jan. 1, 1985

[54] ELECTROGRAPHIC COPY PAPER SUPPORT

[75] Inventor: Robert E. Pettitt, Maplewood, Minn.

[73] Assignee: Minnesota Mining and Manufacturing Company, St. Paul, Minn.

[21] Appl. No.: 516,659

[22] Filed: Jul. 25, 1983

[51] Int. Cl.[3] ..... G03G 15/00

[52] U.S. Cl. ..... 355/16; 118/657

[58] Field of Search ..... 355/3 DD, 16, 10; 118/656, 657, 658, 661; 354/317, 318

[56] References Cited

U.S. PATENT DOCUMENTS

| | | | |
|---|---|---|---|
| 3,207,050 | 9/1965 | Limberger | 355/16 |
| 3,909,258 | 9/1975 | Kotz | 96/1 R |
| 4,081,571 | 3/1978 | Nishihama et al. | 355/3 DD |
| 4,193,330 | 3/1980 | Knox | 83/364 |
| 4,265,153 | 5/1981 | Price, Jr. | 83/372 |

*Primary Examiner*—John F. Gonzales
*Assistant Examiner*—David Warren
*Attorney, Agent, or Firm*—Donald M. Sell; James A. Smith; David W. Anderson

[57] ABSTRACT

A support for maintaining a receptor a predetermined distance from a development roller covered with toner and including a series of channels extending generally perpendicular to the longitudinal axis of the support to permit the passage of accumulated toner through the silhouette of the support. The channels are preferably elliptical in plan perspective and semicircular in transverse cross-section to permit the free passage of toner and are angled to direct toner toward the ends of the development roller.

9 Claims, 5 Drawing Figures

ELECTROGRAPHIC COPY PAPER SUPPORT

BACKGROUND OF THE INVENTION

1. Field of the Invention

This invention relates to electrographic development processes and, more particularly, to a support which maintains a receptor in a proper spaced relationship to a development roller.

2. Description of the Prior Art

An existing electrographic recording process described in detail in U.S. Pat. No. 3,909,258 issued to Kotz and incorporated herein by reference, utilizes a magnetic roller to transport magnetically attractable, relatively electrically conductive toner material around the surface of a development roller and into contact with a receptor which may be zinc oxide coated copy paper. The receptor is provided in an image area with an electrical charge which attracts toner material from the magnetic field and retains the toner particles in such area until they are subsequently affixed to the paper. A surplus of toner material is provided to the copy paper to ensure that all imaged areas are covered. This surplus of toner gradually builds up in a pool, wedge shaped in cross-section, at the interface of the toner and the copy paper.

This accumulation of surplus toner ordinarily causes no problem when a copy of conventional length (up to 14 inches) is produced because the accumulation of surplus toner is very small and is easily spread uniformly by continued movement of the toner and a doctor blade associated with the development roller.

Recently, however, modifications to the copy machine employing the development roller have enabled the production of copies in excess of 100 feet. When copies of such a length were produced, the surplus toner accumulated to such an extent in the conventional development structure that the accumulation could not pass between the development roller and the copy paper which is supported on a guide, called a "gapper", spaced a predetermined distance from the roller. This accumulation of toner remained at the interface of the gapper and the roller even after the copy paper had passed and would not allow subsequent sheets of the copy paper to pass between the development roller and the gapper. The accumulation may also result in contamination of the interior of the copy machine.

The surplus toner may be gradually dissipated by continued rotation of the development roller, but a large number of rotations may be required before a subsequent copy can be produced.

It is, therefore, desirable to provide the copy machine with a support or gapper which will not only properly position the copy paper with respect to the development roller, but also permit the passage of accumulated surplus toner so that such toner may be removed or spread uniformly around the roller.

SUMMARY OF THE INVENTION

In accordance with the present invention, a copy paper support or gapper is provided which includes a series of channels extending generally perpendicular to the longitudinal axis of the gapper which permit the passage of accumulated toner through the silhouette of the gapper. The channels are preferably elliptical in plan and semicircular in cross-section to permit the free passage of toner and are preferably angled to direct toner from the midpoint of the length of the gapper towards its ends. The angle of the channels and the spacing between channels is chosen to provide adequate physical and electrical support to the copy paper.

BRIEF DESCRIPTION OF THE DRAWINGS

The present invention will be more thoroughly described with reference to the accompanying drawings wherein like numbers refer to like parts in the several views, and wherein.

DESCRIPTION OF THE PREFERRED EMBODIMENT

Figure 1:
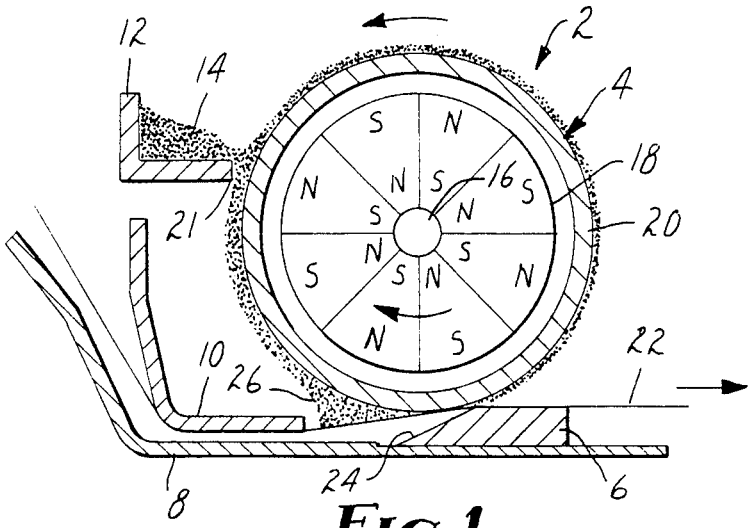
FIG. 1 is a cross-sectional view of a development roller and a gapper of a prototype construction.

FIG. 1 illustrates a development apparatus, generally indicated as 2, which forms a portion of a copy machine. The majority of the apparatus 2 depicted in FIG. 1 is conventional and is described in great detail in U.S. Pat. No. 3,909,258 issued to Kotz and assigned to the assignee of the present invention. U.S. Pat. No. 3,909,258 discloses a process for applying toner particles to a receptor and is incorporated herein by reference. The development apparatus 2 includes a development roller, generally indicated as 4, a receptor support or gapper 6, guides 8 and 10, and a hopper 12 which contains toner particles 14.

The development roller 4 includes a long, cylindrical, magnetically permeable shaft 16 on which are mounted eight long, sector-shaped magnet sections 18 coaxial to the shaft 16. Coaxial to, and surrounding, the magnet sections 18 is an electrically conductive and magnetically permeable hollow cylindrical shell 20 extending axially relative to the shaft 16. Means are provided for connecting the shell 20 to a direct current electrical potential or to ground. The number of magnet sectors 18 is illustrated as eight only for purposes of convenience and illustration. The number may be more or less than this so long as toner 14 transports smoothly around the shell 20.

The toner 14 is finely divided, magnetically attractable and relatively electrically conductive. The toner 14 is located within the hopper 12 located adjacent to, but not touching, the surface of the shell 20. The shell 20 may rotate counterclockwise, as viewed in FIG. 1, to dispense toner 14 from the hopper 12, but preferably, as illustrated in FIG. 1 by directional arrows, the shell 20 remains stationary and the magnet sectors 18 and shaft 16 rotate clockwise to transport the toner material 14 around the shell 20 in a counterclockwise direction. The amount of toner 14 on the shell 20 is controlled by the distance between the hopper edge 21, which serves as a doctor blade, and the surface of the shell 20.

Figure 2:
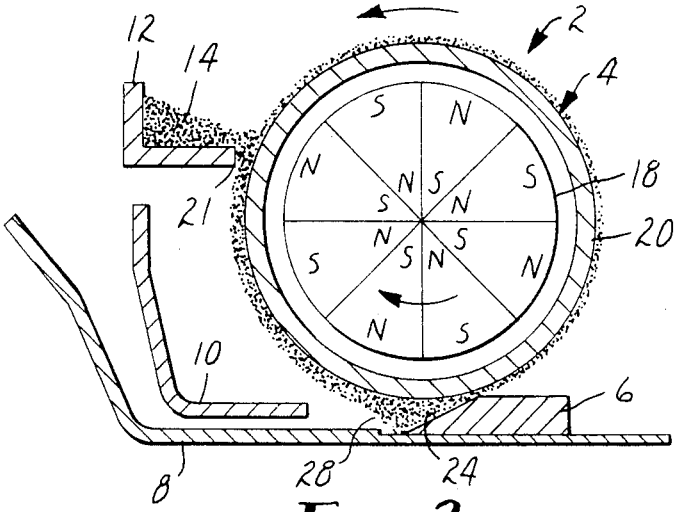
FIG. 2 is a view corresponding to FIG. 1 illustrating the development roller and gapper after the passage of a sheet of copy paper.

The receptor support 6 illustrated in FIGS. 1 and 2 is a prototype construction which has a solid cross-section, extends longitudinally the length of the development roller 4 and is positioned below and in close proximity to the shell 20. The support 6 is usually and will be referred to as a "gapper" because it operates to maintain a predetermined spacing between a receptor 22 and the development roller shell 20. An example of a suitable receptor 22 is paper which includes a photoconductive zinc oxide layer disposed in an insulating binder. The paper 22 is provided with an image pattern by the application of a uniform electrostatic charge followed by exposure to a light pattern. The result is charged, electrically nonconductive image areas and uncharged, electrically conductive nonimage or background areas.

In operation, the paper 22 is guided by the guides 8 and 10 to a sloped forward surface 24 of the gapper 6 which forces the paper 22 into close proximity with the shell 20 and contact with toner particles 14 coating the shell 20. The charged, electrically nonconductive image areas of the paper 22 attract toner particles with a force sufficient to overcome the magnetic attraction which draws the toner 14 toward the shell 20. The charged image areas of the paper 22 thus retain toner particles 14 as the paper 22 travels beyond the gapper 6 while uncharged nonimage areas of the paper 22 cannot retain toner 14 against the force created by the magnet sectors 18. The toner particles 14 adhering to the image areas of the paper 22 are subsequently permanently affixed by means of a pressure roller (not shown) which may or may not be heated.

As the paper 22 progresses past the development roller 4, a wedge-shaped accumulation 26 of surplus toner 14 collects and grows forward of the minimum spacing area between the paper 22 and the shell 20. When the length of the paper 22 is relatively short, as with typical documents, the accumulation 26 of toner 14 is very small and can easily pass between the shell 20 and the gapper 6 after the paper 22 has passed through the development apparatus 2. Any such accumulation 26 is easily smoothed and distributed by the motion of the toner 14 and the edge 21 of the hopper 12.

However, there is presently a demand for a copy machine which can produce copies of such things as oil well logs and electrocardiagrams having a length in excess of 100 feet. The production of such lengthy copies has resulted in a problem not heretofore realized. The passage of long lengths of paper 22 through the development apparatus 2 results in an accumulation 26 of toner in such quantities that the accumulation 26 cannot pass through the space provided between the shell 20 and the gapper 6. There results a pool of toner material or blockage 28, as shown in FIG. 2, between the shell 20 and the gapper 6 which prevents the passage of subsequent sheets of paper 22. The accumulation 26 of toner 14 causing the blockage 28 may extend from the shell 20 completely to the guide 8 and has been found to be more pronounced at the midpoint of the length of the shell 20 than towards its ends.

The accumulation 26 of toner 14 may eventually be cleared upon continued rotation of the magnet sectors 18, although a large number of complete rotations will be necessary. The accumulation 26 thus results in at least a delay between copies and may result in contamination of other portions of the copy machine because the accumulation 26 is only tenuously maintained in contact with the shell 20 by magnetic attraction.

A gapper 30 of the present invention (FIG. 3) allows the passage and immediate clearing of the accumulation 26 by providing channels 32 which permit the passage of the accumulation 26 of toner 14 through the silhouette of the gapper 30 and simultaneously redistribute the accumulation 26 toward the ends of the gapper 30 and the development roller 4.

Figure 3:
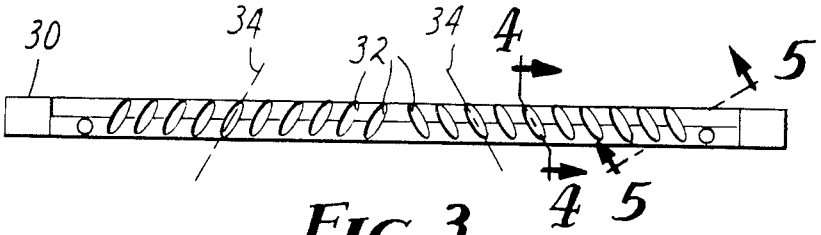
FIG. 3 is a plan view of the gapper of the present invention.

The channels 32 are rounded in all dimensions and appear in the plan perspective of FIG. 3 as ellipses. The major axes 34 of the channels 32 on each side of the center of the gapper 30 are parallel and are all angled with respect to the longitudinal axis of the gapper 30 toward the center of the gapper 30 and the development roller 4.

Figure 4:
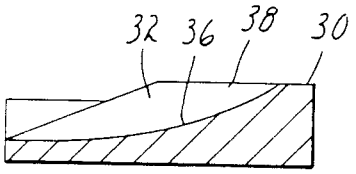
FIG. 4 is an enlarged longitudinal cross-sectional view of the gapper of FIG. 3 taken generally along line 4—4 of FIG. 3.

FIG. 4 illustrates that the bottom surfaces 36 of the channels 32 are formed as an arc of a circle having a radius equal to the radius of the shell 20 plus the anticipated cross-sectional dimension of the toner accumulation 26. Thus, the bottom surfaces 36 of the channels 32 are on an extended radius of the development roller 4 and will allow the free passage of the accumulation 26.

Figure 5:
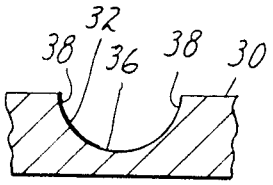
FIG. 5 is an enlarged, partial transverse cross-sectional view of the gapper of FIG. 3 taken generally along line 5—5 of FIG. 3.

FIG. 5 illustrates that the channels 32 are circular in transverse cross-section to eliminate corners which might capture toner 14 which would disturb the passage of the accumulation 26 through the gapper 30.

The channels 32 themselves thus allow the free passage of any accumulation 26 of toner 14 through the silhouette of the gapper 30 and the orientation of the channels 32 serves to redistribute toner 14 from the midpoint of the shell 20 toward the ends of the shell 20.

The axes 34 of the channels 32 are preferably oriented at an angle of 60° with respect to the axis of the gapper 30 to optimally perform the functions of the gapper 30 which include permitting the free passage of toner 14, redistributing the toner 14 as it passes through the gapper 30 and supporting the paper 22 physically and electrically as it passes over the gapper 30. Electrical support means that the paper 22 must be in electrically conductive contact with the gapper 30 so that stray charges may be conducted away from nonimage areas. A loss of electrical support for an extended time may result in the accumulation of an electrical charge and undesirable toner 14 adherence in a nonimage area. To achieve this support along the width of the paper 22, the channels 32 preferably terminate short of the boundaries of the gapper 30 so that all portions of the paper 22 will contact the gapper 30 as the paper 22 passes over the gapper 30.

An angle of greater than 60° (more nearly perpendicular to the axis of the gapper 30) would perhaps permit freer passage of toner 14 through the gapper 30, but would not as effectively redistribute toner 14, may result in distortion of the paper 22 into a cup shape between the sides 38 of the channels 32 and would not provide effective electrical support to the paper 22 because the paper 22 would be out of contact with the gapper 30 along the length of the channels 32.

An angle of less than 60° (more nearly in line with the longitudinal axis of the gapper 30) might more effectively redistribute toner 14 and support the paper 22, but might result in the sides 38 of the channels 32 skiving toner 14 as the accumulation 26 passes through the silhouette of the gapper 30.

It is contemplated, however, that the channels 32 could be oriented at progressively increasing angles with respect to the longitudinal axis of the gapper 30 from the midpoint of the gapper 30 toward the ends of the gapper 30 so that the channels 32 adjacent the midpoint would be oriented at an angle such as 60° while the channels 32 located at the ends would be oriented at an increased angle (more nearly perpendicular to the axis of the gapper 30). This would orient the channels 32 so as to provide maximum redistribution of the toner 14 at the midpoint of the shell 20; the position where most of the toner 14 accumulates.

Although the invention has been described with respect to a single embodiment, modifications should be apparent to those skilled in the art. It is intended that the invention include those modifications falling within the scope and intent of the appended claims.

I claim:

1. A support for maintaining copy paper a predetermined distance from a cylindrical development roller carrying a ccating of toner particles, the support having a longitudinal axis parallel to the axis of the roller and comprising a surface facing said roller, said surface having a series of channels formed in and spaced along said surface and angled toward the center of the length of said support to permit the passage of toner through the silhouette of said support and to redistribute toner passing through said support toward the ends of said roller.

2. A support according to claim 1 wherein said channels on either side of said center of said support are parallel and are angled at approximately 60° with respect to said support longitudinal axis toward said center.

3. A support according to claim 1 wherein said channels includes a bottom surface which is concave with respect to said roller in longitudinal cross-section.

4. A support according to claim 3 wherein said bottom surface is coincidental with a radius extending from the center of said roller.

5. A support according to claim 1 wherein said channels are continuously curved and concave with respect to said roller in transverse cross-section.

6. A support according to claim 5 wherein said channels are semicircular in transverse cross-section.

7. A support according to claim 1 wherein said channels are elliptical in plan perspective and are contained within the borders of said support.

8. A support according to claim 7 wherein said channels include a bottom surface coincidental with a radius extending from the center of said roller, are semicircular in transverse cross-section, and are angled toward the center of the length of said support to redistribute toner passing through said support toward the ends of said roller.

9. A support according to claim 8 wherein said channels are on either side of said center of said support are parallel and are angled toward said center at approximately 60° with respect to said support longitudinal axis.

* * * * *